United States Patent [19]

Wiczer

[11] Patent Number: 4,504,057

[45] Date of Patent: Mar. 12, 1985

[54] PINBALL GAME AND ROTATABLE BUMPER THEREFOR

[75] Inventor: Max Wiczer, Skokie, Ill.

[73] Assignee: Wico Corporation, Niles, Ill.

[21] Appl. No.: 452,711

[22] Filed: Dec. 23, 1982

[51] Int. Cl.[3] ..... A63F 7/02; A63F 7/36

[52] U.S. Cl. ..... 273/119 R

[58] Field of Search ..... 273/119 R, 121 R, 121 A, 273/122 R, 122 A, 129 V, 129 W, 119 A

[56] References Cited

U.S. PATENT DOCUMENTS

| | | | |
|---|---|---|---|
| 1,454,982 | 5/1923 | Pye | 273/119 R |
| 1,600,624 | 9/1926 | De Boer | 273/119 R |
| 1,686,124 | 10/1928 | Brower | 273/109 X |
| 2,089,514 | 8/1937 | Walker | 273/121 R |
| 2,551,698 | 5/1951 | Pearl et al. | 273/121 A |
| 3,391,937 | 7/1968 | Seiden | 273/119 R X |
| 3,901,511 | 8/1975 | Garbark | 273/119 R |
| 4,239,222 | 12/1980 | Hori | 273/121 R |
| 4,361,327 | 11/1982 | Kurita et al. | 273/119 R |
| 4,438,928 | 3/1984 | Wiczer | 273/121 R |

FOREIGN PATENT DOCUMENTS

| | | | |
|---|---|---|---|
| 2611529 | 9/1977 | Fed. Rep. of Germany | 273/121 A |
| 1489138 | 7/1967 | France | 273/119 R |

*Primary Examiner*—Richard C. Pinkham
*Assistant Examiner*—Scott L. Brown
*Attorney, Agent, or Firm*—Emrich & Dithmar

[57] ABSTRACT

A pinball game includes a playfield board on which a pinball rolls for engagement with targets carried by the board. A shooter mechanism projects the pinball into rolling engagement along the board in a predetermined path against a rebound device which is manually rotatable to change the direction in which the ball rebounds therefrom for directing the ball at the targets.

3 Claims, 4 Drawing Figures

PINBALL GAME AND ROTATABLE BUMPER THEREFOR

BACKGROUND OF THE INVENTION

The present invention relates to a pinball game of a type wherein a ball rolls along an inclined playfield board for interaction with targets or the like.

Many variations of pinball-type games are known which include means for introducing the ball into play by projecting it along the playfield board. The ball then engages various target elements which may be of several types. One type of target element is an active kicker which responds to impact of the ball therewith for positively imparting to the ball an additional propelling force. Other types of target members comprise fixed bumpers which are simply passive resilient members from which the ball rebounds with a force determined by the speed of the ball at impact. Typically, the direction in which the ball rebounds from such bumper devices is determined solely by the direction of incidence.

SUMMARY OF THE INVENTION

It is a general object of this invention to provide an improved pinball game which avoids certain disadvantages of prior pinball game devices while affording additional structural and operating advantages.

It is an important object of this invention to provide a passive rebound device for a pinball game wherein the direction of rebound of the ball can be controlled independently of its direction of incidence.

In connection with the foregoing object, it is another object of this invention to provide a passive rebound device which is movable to control the direction of rebound therefrom.

In connection with the foregoing object, it is another object of this invention to provide a passive rebound device of the type set forth which is manually rotatable by the user.

In connection with the foregoing objects, still another object of this invention is the provision of a pinball game incorporating a passive rebound device of the type set forth.

These and other objects of the invention are attained by providing a pinball game including a playfield board with one or more targets thereon and means for propelling a pinball into rolling engagement with the playfield board along a predetermined path, the improvement comprising: a passive rebound device disposed on the playfield board along the path for engagement with a pinball propelled along the path, means movably mounting the rebound device on the playfield board, and actuating means coupled to the mounting means for effecting movement of the rebound device, thereby to vary the direction in which a pinball rebounds from the rebound device.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
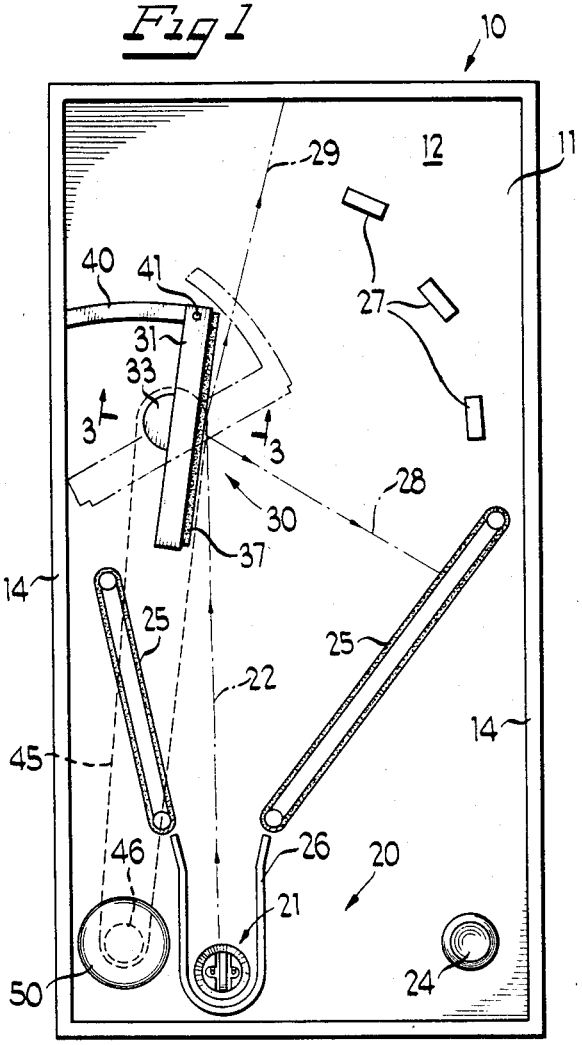
FIG. 1 is a top plan view of a pinball game constructed in accordance with and embodying the features of the present invention.
Figure 2:
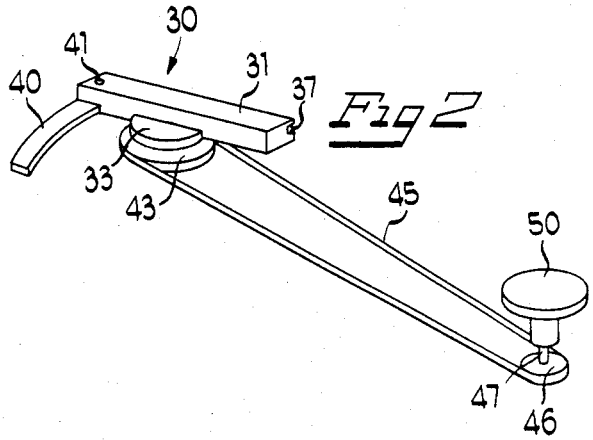
FIG. 2 is a perspective view of the movable rebound device of the pinball game of FIG. 1.
Figure 4:
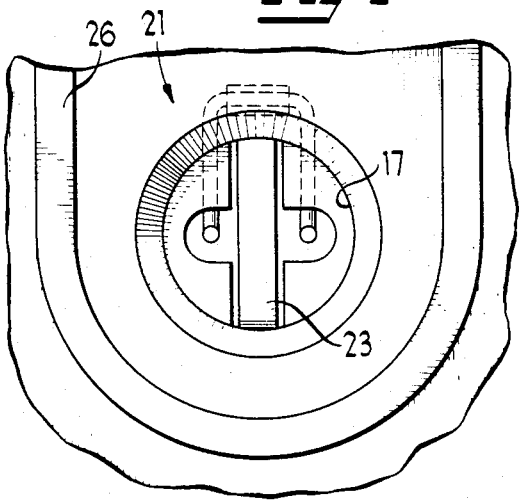
FIG. 4 is an enlarged, fragmentary, top plan view of the kicker assembly of the pinball game of FIG. 1.
Figure 3:
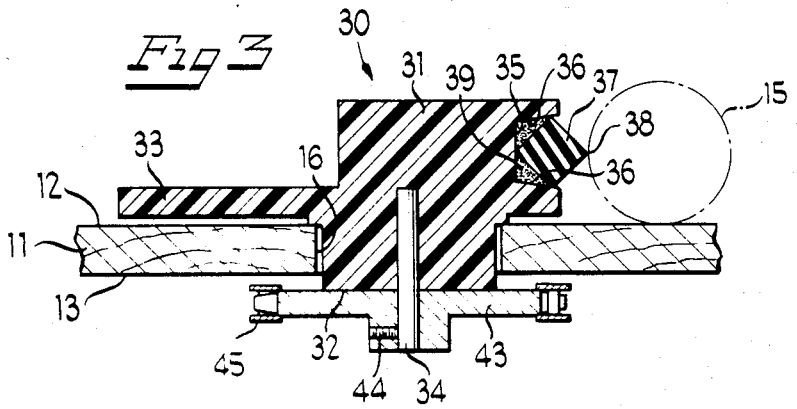
FIG. 3 is an enlarged, fragmentary view in vertical section taken along the line 3—3 in FIG. 1.

Referring to the drawings, there is illustrated a pinball game, generally designated by the numeral 10, which includes a flat rectangular playfield board 11 having a top surface 12 and a bottom surface 13 and provided around the entire perimeter thereof with an upstanding peripheral wall 14. In use, the playfield board 11 is disposed in a slightly inclined position so that a pinball 15 rolling therealong will tend to return to the low end of the board. Formed in the playfield board 11 is a circular aperture 16 intermediate the upper and lower ends thereof and a circular aperture 17 disposed adjacent to the lower end thereof.

The pinball game 10 includes a shooter mechanism, generally designated by number 20, which includes an out-hole kicker assembly 21 disposed immediately beneath the aperture 17. The kicker assembly 21 includes a kicker member 23 which projects upwardly into the aperture 17, the aperture 17 being dimensioned to accommodate a pinball 15 therein. The kicker assembly 21 is of standard construction and is electrically operated by a solenoid (not shown), a control button 24 being provided on the playfield board for selectively actuating the kicker assembly 21 for projecting a pinball 15 therefrom into rolling engagement with the top surface 12 of the playfield board 11 along a predetermined path 22. Guides 25 converge downwardly toward the kicker assembly 21 and cooperate with a guide 26 to guide a spent pinball 15 back to the aperture 17 so that it can be again projected into play by actuation of the kicker assembly 21, all in a well known manner. Preferably a number of targets 27 are provided on the playfield board 11 for engagement by the rolling pinball 15. The targets 27 are diagrammatically illustrated in FIG. 1, it being understood that the targets 27 could be of any number of different well-known types.

It is a significant aspect of the present invention that the pinball game 10 also includes a rebound device or bumper 30, which includes an elongated frame 31 generally rectangular in transverse cross section and having a cylindrical pivot post 32 integral therewith substantially midway between the ends thereof and depending therefrom, the pivot post 32 being dimensioned to fit in the aperture 16 in the playfield board 11 for rotation about the axis thereof. Integral with the pivot post 32 at the upper end thereof and projecting rearwardly therefrom is an arcuate projection 33, disposed in use above the playfield board 11 when the pivot post 32 is disposed in the aperture 16. Embedded in the pivot post 32 coaxially therewith and depending a predetermined distance therefrom is a pin or shaft 34.

Formed in the front side of the frame 31, i.e., the side opposite the arcuate projection 33, is an elongated recess 35 which extends the length of the frame 31 and is generally trapezoidal in transverse cross section. More specifically, the recess 35 has a substantially vertical inner wall, integral at the upper and lower ends thereof with sloping walls 36 which diverge outwardly, respectively at the top and bottom of the recess 35. Seated in the recess 35 is an elongated, flexible, resilient bumper strip 37, which may be formed of rubber or the like, and is substantially square in transverse cross section. The bumper strip 37 is seated in the recess 35 on an angle, so that three of the corners thereof respectively engage the rear wall and the sloping walls 36 of the recess, the other corner 38 of the bumper strip 37 projecting outwardly a predetermined distance beyond the front surface of the frame 31 for engagement by a rolling pinball 15. It will be appreciated that the sloping walls 36 serve to facilitate a wedge fit of the bumper strip 37 in the recess 35, the bumper strip 37 preferably being adhesively secured in place by a suitable adhesive 39.

The dimensions of the rebound device 30 are such that the projecting rebound edge 38 of the bumper strip 37 is disposed substantially parallel to the top surface 12 of the playfield board 11 and spaced therefrom a distance approximately equal to the radius of a pinball 15. An arcuate stop member 40 may be fixedly secured to the frame 31 at one end thereof, as by a fastener 41, and projects rearwardly therefrom toward the adjacent portion of the peripheral wall 14 of the playfield board 11. In use, this stop member 40 is engageable with the peripheral wall 14 to limit rotational movement of the rebound device 30 in a counterclockwise direction, as viewed in FIG. 1.

Fixedly secured to the projecting portion of the pin 34 beneath the playfield board 11 is a sprocket 43 which may be held in place by a set screw 44. A drive chain 45 couples the sprocket 43 to another sprocket 46 which is disposed beneath the playfield board 11 and is fixedly secured to a shaft 47 for rotation therewith. The shaft 47 projects upwardly through a complementary aperture in the playfield board 11 and at the upper end thereof is secured to a control knob 50 disposed above the playfield board 11 for access by a user. In operation, it will be appreciated that manual rotation of the control knob 50 effects a corresponding rotation of the rebound device 30 about the axis of the pin 34.

The rebound device 30 is mounted on the playfield board in a position such that the bumper strip 37 generally faces the shooter mechanism 20 and intersects the predetermined path 22 followed by the pinball 15 when it is projected from the kicker assembly 21. Thus, in operation, the pinball 15 is projected by the shooter mechanism 20 against the bumper strip 37 of the rebound device 30 and rebounds therefrom at a rebound angle which is substantially equal to the angle of incidence, in a well known manner. However, by operation of the control knob 50, the player can change the orientation of the rebound device 30 by pivoting it about the axis of the pin 34, thereby varying the angle of incidence with the ball path and accordingly varying the angle and direction of rebound. Thus, it will be appreciated that in this manner, the direction in which the ball 15 rebounds from the rebound device 30 can be selectively varied substantially between extremes indicated by the rebound paths 28 and 29, respectively corresponding to the extremes of rotation of the rebound device 30, even though the pinball 15 is always projected along the same predetermined path 22 from the kicker assembly 21. Thus, a player can direct the pinball 15 toward selected ones of the targets 27 by pivoting the rebound device 30. It will be understood that the rotation of the rebound device 30 in one direction is limited by engagement of the stop member 40 with the peripheral wall 14, and its rotation in the opposite direction may be limited by engagement of the other end of the frame 31 with the peripheral wall 14, these two extreme positions being respectively illustrated in solid line and broken line in FIG. 1. Alternatively, another stop device could be provided at the other end of the frame 31.

In a constructional model of the present invention, the frame 31 and the pivot post 32 are of unitary one-piece construction, preferably being molded of plastic, the pin 34 being molded in place in the pivot post 32. It will be appreciated that other known types of shooter mechanisms could be used in place of the kicker assembly 21, and any desired type of target arrangement, auxiliary bumpers, guides and the like could be used to vary the strategy and play of the game.

From the foregoing, it can be seen that there has been provided an improved pinball game which includes a manually movable passive rebound device for selectively varying the direction in which a pinball rebounds therefrom.

I claim:

1. In a pinball game including a playfield board with one or more targests thereon, the improvement comprising: means for propelling a pinball into rolling engagement with the playfield board along a single predetermined path, a passive rebound device disposed on said playfield board along the path, means movably mounting said rebound device on the playfield board for movement among a plurality of stationary rebound positions, said rebound device in each of said rebound positions being passively disposed for engagement by a pinball propelled along said path for deflecting the pinball in a direction corresponding to the rebound positon without accelerating the pinball, and positioning means coupled to said mounting means and operable when the pinball is at rest for selectively positioning said rebound device in a selected one of said rebound positions to determine the direction in which the pinball will be deflected during the next propulsion thereof, thereby to vary the direction in which a pinball rebounds from said rebound device.

2. The pinball game of claim 1, wherein said actuating means includes a control member and linkage interconnecting said control member ans said mounting means.

3. The pinball game of claim 2, wherein said mounting means mounts said rebound device for rotation about an axis disposed substantially perpendicular to the playfield board said control member comprising a manually operable knob rotatably mounted on said playfield board, said linkage comprising a chain and sprocket assembly.

* * * * *